US006696116B2

(12) United States Patent
Bigman

(10) Patent No.: US 6,696,116 B2
(45) Date of Patent: Feb. 24, 2004

(54) DEVICE AND METHOD FOR FLOWING PELLETS

(76) Inventor: Cary Bigman, 6124 Corbin Ave., Tarzana, CA (US) 91356

( * ) Notice: Subject to any disclaimer, the term of this patent is extended or adjusted under 35 U.S.C. 154(b) by 30 days.

(21) Appl. No.: 09/895,952

(22) Filed: Jun. 29, 2001

(65) Prior Publication Data

US 2001/0046572 A1 Nov. 29, 2001

Related U.S. Application Data

(63) Continuation of application No. 09/426,490, filed on Oct. 26, 1999, now abandoned.

(51) Int. Cl.[7] ..... A41G 1/00

(52) U.S. Cl. ..... 428/18; 40/410; 472/65; 239/120; 239/121; 239/127; 239/211; 239/11; 239/12; 138/40; 138/45; 138/46

(58) Field of Search ..... 428/18, 19, 15; 40/409, 410; 472/65; 239/2.2, 14.2, 211, 120, 121, 127, 11, 12; 138/37, 40, 44, 45, 46

(56) References Cited

U.S. PATENT DOCUMENTS

| | | | | |
|---|---|---|---|---|
| 3,414,512 | A | | 12/1968 | Burnbaum |
| 3,415,513 | A | | 12/1968 | Burnbaum |
| 3,646,971 | A | * | 3/1972 | Godet |
| 4,028,830 | A | | 6/1977 | Ottinger |
| 4,076,234 | A | | 2/1978 | Burnbaum |
| 4,464,112 | A | * | 8/1984 | Heinemann et al. |
| 4,962,922 | A | | 10/1990 | Chu |
| 5,200,239 | A | | 4/1993 | Chen |
| 5,412,888 | A | | 5/1995 | Rickuss et al. |

* cited by examiner

*Primary Examiner*—Deborah Jones
*Assistant Examiner*—Wendy Boss
(74) *Attorney, Agent, or Firm*—Edward A. Sokolski

(57) ABSTRACT

Pellets which may, for example, simulate snow are brought to a position such as the top of a tree from where they are dispensed. After falling to the bottom. the pellets are collected and re dispensed. The pellets are blown through a venturi tube and from there to a tube which runs to the position at where the pellets are dispersed. An adjustable flap is provided in the venturi tube, this flap functioning both to contribute to the venturi action controlling the fluid pressure and as a valve to control the rate of flow of pellets for optimum operation.

4 Claims, 3 Drawing Sheets

DEVICE AND METHOD FOR FLOWING PELLETS

RELATED APPLICATION

This application is a continuation of application Ser. No. 09/426,490 filed Oct. 26, 1999 now abandoned and claims the priority of that application.

BACKGROUND OF THE INVENTION

1. Field of the Invention

This invention relates to the flow of pellets which may simulate snow and more particularly to an apparatus and method for effecting and controlling such flow.

2. Description of the Related Art

Prior art devices and methods are known for effecting the flow of pellets which may simulate snow. Such devices are often utilized to simulate the flowing of snow on a Christmas tree and generally employ a blower which blows the pellets into a venturi tube through which such particles are drawn through a tube to the top of the tree and then dispensed. When the particles reach the bottom of the tree, they are recirculated to the top. Such prior art devices are described in U.S. Pat. No. 5,412,888 issued May 9, 1995 to Rickuss et al.; U.S. Pat. No. 5,200,239 issued Apr. 6, 1993 to Chen; and U.S. Pat. No. 4,962,922 issued Oct. 16, 1990 to Chu. In none of these prior art devices is there any mechanism for changing the venturi action to enable variations in the fluid pressure and simultaneously changing the rate of flow of pellets. Without such an adjustment, neither the rate or velocity of the flow can be controlled which could result in overflow leading to blockage of the tube thereby terminating the flow of pellets. Further, to produce different effects, in certain situations a greater flow volume or velocity of flow is desired and in others a lesser flow and velocity of flow is needed. Also, the flow volume and velocity of flow may be governed by the size of the pellets.

SUMMARY OF THE INVENTION

The device and method of the present invention by enabling control of the volume and velocity of flow of the pellets as pointed out above, provides distinct advantages over the prior art.

The system of the present invention includes a venturi tube which is part of a flow channel from a supply position to a dispensing position generally above the supply position. Pellets stored in a container member are sucked into the venturi tube and from there are fed to one end of an elongated tube. The pellets are driven by the air pressure to the opposite end of the tube where they are dispensed to fall downwardly onto an object such as a Christmas tree. The particles fall through the object and are collected in the container member for recycling. An adjustable flap member is formed in the venturi tube, the opening provided by this flap member valve being manually adjustable to vary the size of the opening in the venturi tube. In this manner, the venturi action of the venturi tube is set to determine the pressure differential between the input and output of the venturi tube with the position of the flap simultaneously determining the rate of flow of pellets through the venturi tube.

It is therefore an object of this invention to provide an improved system and method for dispensing pellets;

It is a further object of this invention to provide a system and method for dispensing pellets in which the rate of flow of the pellets and the air pressure driving such flow can be simultaneously controlled;

It is a still further object of this invention to provide a system and method utilizing a venturi tube for dispensing pellets at a predesired velocity and volume to simulate snowfall on a tree.

Other objects of the invention will become apparent from the following description in conjunction with the accompanying drawings.

DETAILED DESCRIPTION OF THE INVENTION

Figure 1:
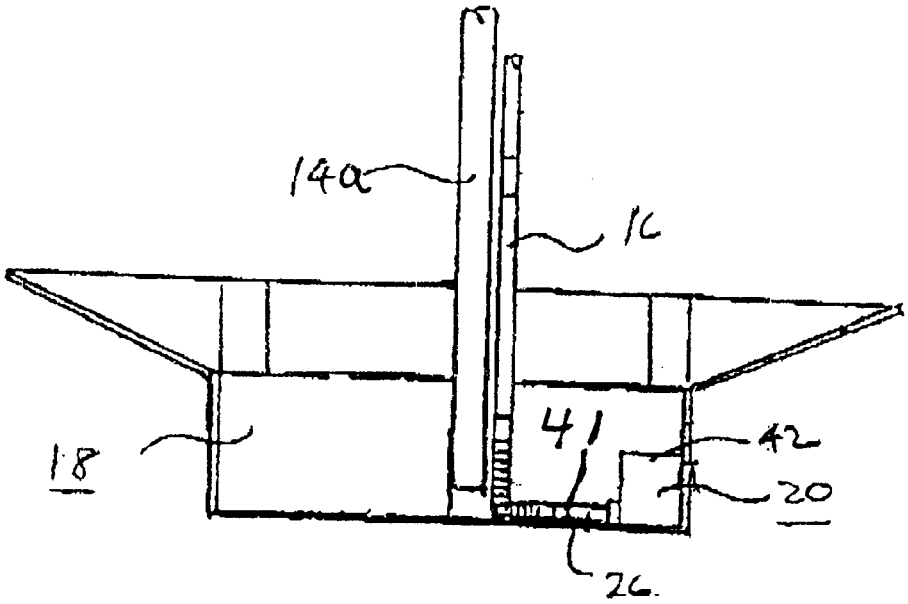
FIG. 1 is a side elevational view partly fragmentary illustrating the pellet driving device of the preferred embodiment of the invention.

Referring now to the drawings, a preferred embodiment of the invention is illustrated.

Figure 2:
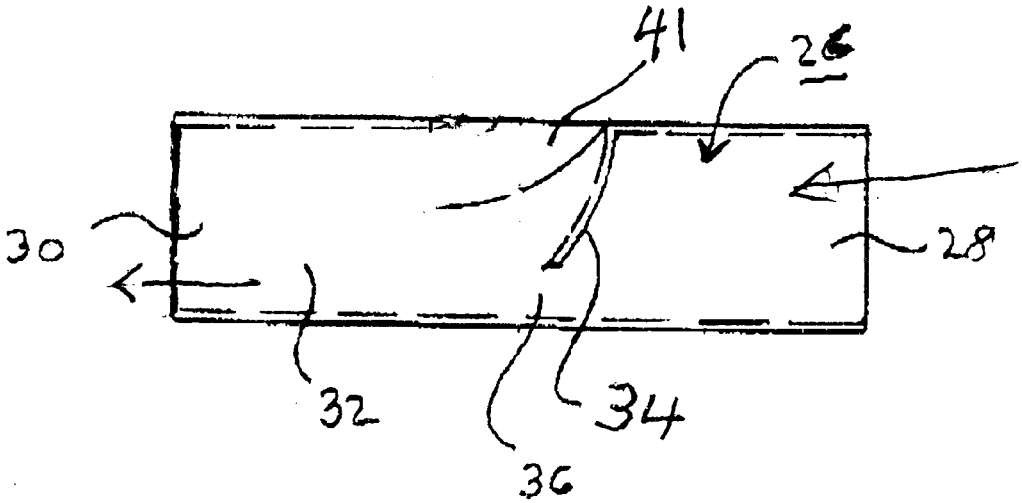
FIG. 2 is a side elevational view, partly in section of the valve mechanism at the entrance to the venturi tube of the preferred embodiment.
Figure 3:
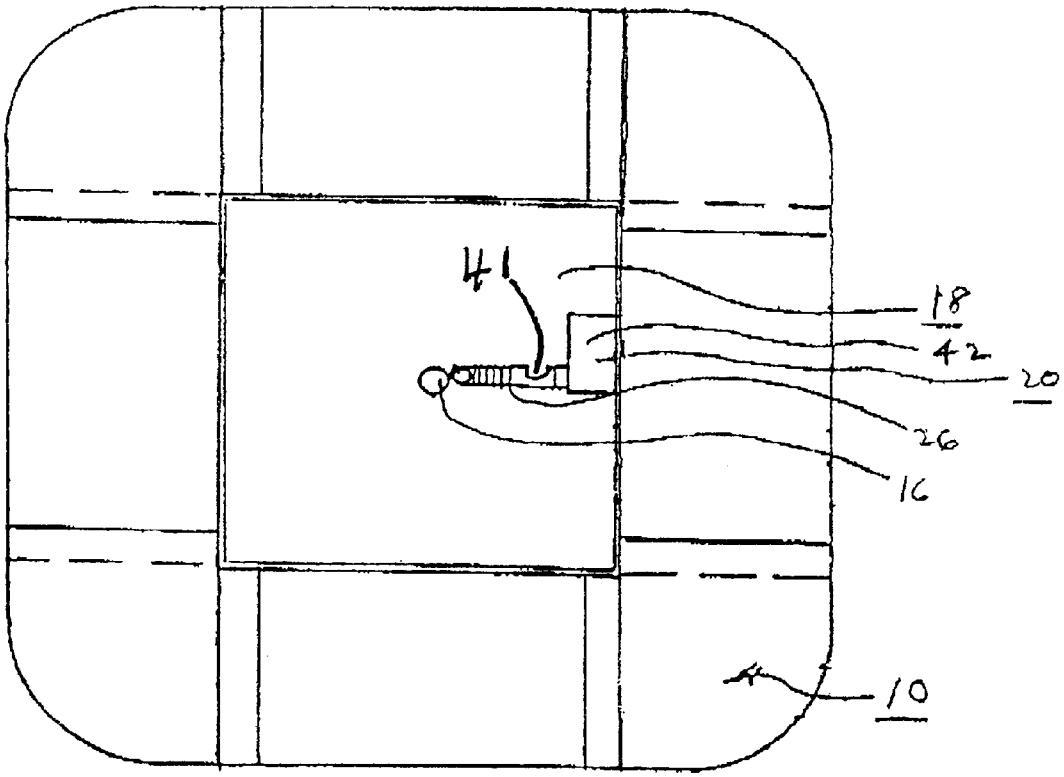
FIG. 3 is a top plan view partly in section of the venturi tube and valve and collecting container of the preferred embodiment.
Figure 4:
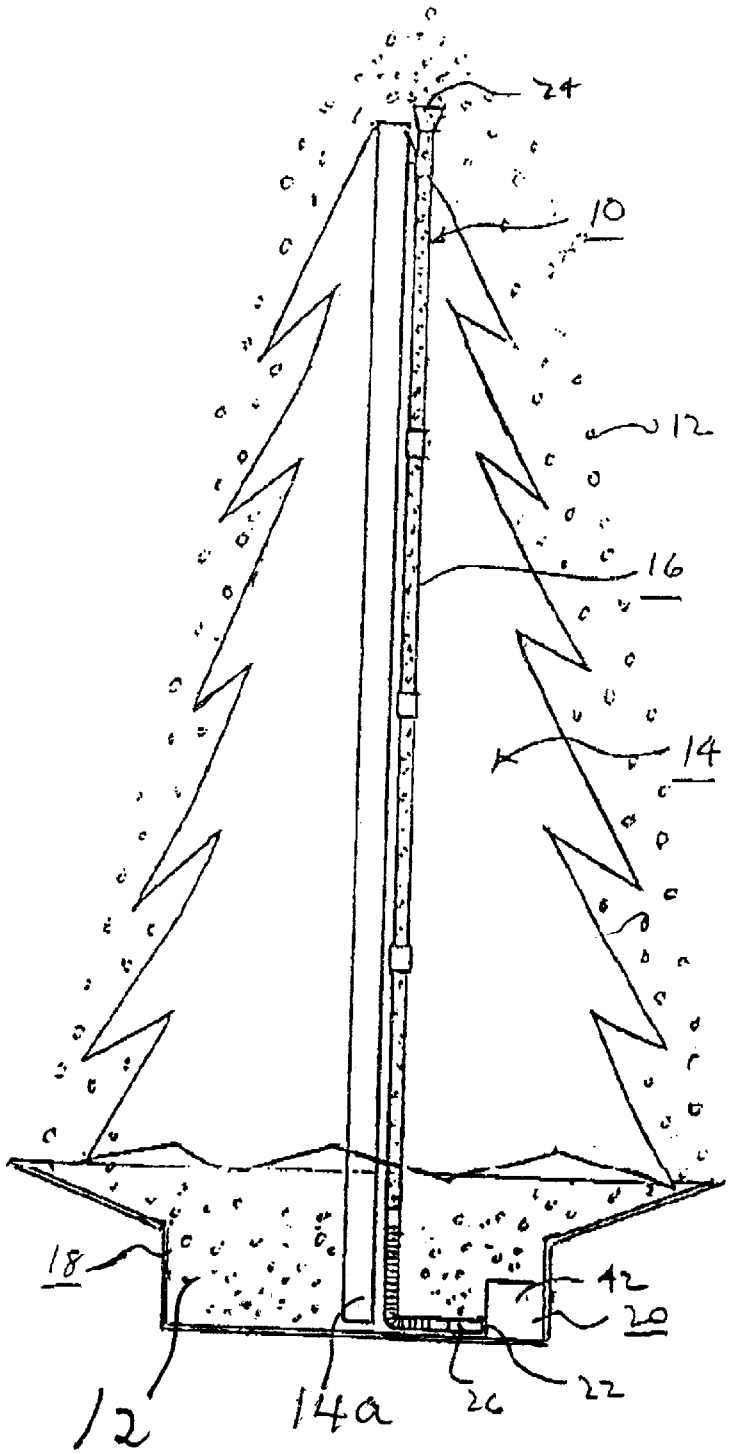
FIG. 4 is an elevational view of a typical installation of the preferred embodiment on a tree.

As best can be seen in FIG. 4, the system of the invention 10 generates the upward movement of pellets by means of a blower device 42 driven by motor 20 which sucks the pellets through an inlet 41 formed in the wall of venturi tube section 26(See FIGS. 2 and 4). The velocity of the movement of the pellets is enhanced by means of venturi tube 26, the space 36 of which is restricted by means of flexible flap 34. The amount of space 36 which varies in accordance with the position of flap 34 determines the degree of venturi action(i.e. the pressure differential between the inlet and outlet of the tube). The rate of flow of pellets is also determined by the position of flap 34 which acts as a valve to control the opening 41. As the flap is brought to its closed position (as shown by the dotted line) to allow less flow, the venturi action is decreased and vice versa. Flap 34 can be manually adjusted and thus functions to vary the venturi action and acts as a valve by means of which the rate of flow of pellets can be controlled.

The pellets are driven by the blower through tube 16 and dispensed at the top end thereof through outlet 24. Tube 16 is supported on the support 14*a* for tree 14, the pellets being dispensed onto the tree. The falling pellets are collected in container 18 for recirculation to the top of the tree through tube 16.

Venturi flap 34 and the tube wall from which it extends are fabricated of a flexible plastic or metal which may for example be thin walled ABS pipe or PVC. This flap can be set in position manually and will hold in this position until and unless reset. The inlet 41 can thus be set as desired and need be to control the flow of pellets into pipe 16. In this manner, blockage can be avoided, flow can be adjusted to meet various requirements and individual needs, and large or smaller sized pellets can be accommodated for. At the same time, the setting of the flap determines the degree of venturi action.

The pellets 12 may be artificial snowflakes, artificial water droplets, etc. The "object" may as shown in the illustrative example be a Christmas tree, or other holiday related object such as a champagne bottle, etc. The effect created by the movement of the pellets 12 relative to object 14 may be a cascading snowfall, a water droplet effect, etc.

Container 18, which is open at its top, supports tube 16 and blower 42 in addition to collecting the pellets to be recirculated.

The operation of the system of the invention is as follows: Tube 16 is positioned close to the object 14. A flow of pellets 12 is then generated by means of the airflow generated by blower 42. The flow of pellets passes through inlet 41, the flow rate being determined by the setting of "valve" flap 34. The degree of venturi action is also determined by the setting of flap 34. The pellets move from the venturi though tube 16 and are expelled from the outlet 24 thereof onto tree 14. The pellets falling from the tree are collected in container 18 and recirculated onto the tree again in the same manner as just described.

While the invention has been described and illustrated in detail it is to be understand that this is intended by way of illustration and example only, the scope of the invention being limited by the terms of the following claims.

I claim:

1. A system for effecting the flow of pellets simulating snow from a container to a position adjacent to an object from where said pellets are fed onto said object comprising:

a main tube having an outlet adjacent to the pellets simulating snow in said container and an outlet adjacent to said object;

said main tube including a venturi tube at the inlet thereof having an adjustable flap formed from the wall of said venturi tube and projecting inwardly from an inner wall thereof, said flap being manually positionable between a position where it closes said venturi tube a predetermined maximum amount and a position whereat it opens said venturi tube a predetermined maximum amount, the position of said flap simultaneously determining the action of said venturi tube in setting the pressure differential between the opposite ends of said venture tube and the rate of flow of said pellets into said main tube;

said pellets being collected in said container after flowing over said object; and blower means for generating air flow for driving said pellets from said container through said main tube onto said object.

2. The system of claim 1 wherein said object is a Christmas tree.

3. A method for effecting the flow of pellets simulating snow over an object at a preselected rate comprising the steps of:

blowing the pellets through a tube to the vicinity of said object and releasing the pellets onto the object;

controlling the flow of said pellets through a venturi tube section of said tube having a flap formed from the wall of said tube section to implement the variation of said venturi action; and variously manually setting said flap in any position between maximum and minimum openings to vary the passage between said flap and the wall of said tube section, the setting of said flap in said position providing a predetermined fluid pressure on said pellets by virtue of venturi effect which causes a predetermined rate of flow of said pellets through said tube.

4. The method of claim 3 wherein said object is a tree.

* * * * *